United States Patent [19]

Straubel

[11] Patent Number: 4,767,288

[45] Date of Patent: Aug. 30, 1988

[54] FUEL INJECTION PUMP

[75] Inventor: Max Straubel, Stuttgart, Fed. Rep. of Germany

[73] Assignee: Robert Bosch GmbH, Stuttgart, Fed. Rep. of Germany

[21] Appl. No.: 380,853

[22] Filed: May 21, 1982

[30] Foreign Application Priority Data

Jun. 11, 1981 [DE] Fed. Rep. of Germany ..... 3123138

[51] Int. Cl.[4] ..... F04B 19/02; F02M 39/00

[52] U.S. Cl. ..... 417/462; 417/505; 123/450; 123/458

[58] Field of Search ..... 417/202, 203, 205, 206, 417/221, 244, 251, 253, 462, 505; 123/450, 458, 506, 500

[56] References Cited

U.S. PATENT DOCUMENTS

| | | | |
|---|---|---|---|
| 3,161,138 | 12/1964 | Koster | 417/462 |
| 3,598,507 | 8/1971 | Voit et al. | 417/505 |
| 4,037,574 | 7/1977 | Swift | 417/221 |
| 4,180,037 | 12/1979 | Hobo et al. | 123/506 |
| 4,398,518 | 8/1983 | Leblanc et al. | 123/458 |
| 4,445,822 | 5/1984 | Hoshi | 123/450 X |
| 4,446,836 | 5/1984 | Mowbray et al. | 123/458 X |
| 4,508,081 | 4/1985 | Takane | 123/450 |

FOREIGN PATENT DOCUMENTS

| | | | |
|---|---|---|---|
| 53-80803 | 7/1978 | Japan | 417/462 |
| 1306422 | 2/1973 | United Kingdom | 123/450 |

*Primary Examiner*—Carlton R. Croyle
*Assistant Examiner*—Paul F. Neils
*Attorney, Agent, or Firm*—Edwin E. Greigg

[57] ABSTRACT

A fuel injection pump is proposed in which the fuel supply quantity supplied to the injection location is determined by metering the quantity of fuel aspirated. The metering of the aspirated quantities is effected with the aid of at least one magnetic valve which is located in the fuel supply line leading to the fuel injection pump and with the aid of a control edge moved in synchronism with the rotation of the fuel injection pump, which controls the communication between the fuel supply line and the pump work chamber in series with the magnetic valve. The opening times of the two control locations are each longer than the maximum metering time, the overlapping time of the two control times determining the opening time of the communication between the fuel supply and the pump work chamber. The metering time is thus determined on the one hand by the switching time of the control edge moved in synchronism with the rpm and the other by a switching process of the magnetic valve.

2 Claims, 2 Drawing Sheets

FUEL INJECTION PUMP

BACKGROUND OF THE INVENTION

The invention is based on a fuel injection pump. In an injection pump of this type, known from German Offenlegungsschrift No. 19 19 969, the fuel quantity which is to be injected during the supply stroke of the pump piston of the injection pump is metered during the suction stroke of the pump piston by means of the magnetic valve, which is controlled either in increments or in analog fashion. The metered quantity is determined by the opening time of the magnetic valve, the opening phase of this valve being located exclusively within the period of the suction stroke of the pump piston. In this known apparatus, pressure conditions in the work chamber of the fuel injection pump influence the metered quantity. Depending upon the instant of opening of the magnetic valve, a more or less reduced pressure prevails in the work chamber. For precise metering of the fuel injection quantity, the rpm and the instant of injection must be taken into consideration in this known apparatus in order to set the opening times of the magnetic valve. Pressure fluctuations in the work chamber during the fill process must also be considered. Further disadvantages are associated with the limited speed of switching of the magnetic valve. The two switching processes of the magnetic valve which take place during the metering phase thus affect the precision of the product of metering. Furthermore, there are limits on the rpm or the rotary speed of the injection pump because of the switching time of the magnetic valve.

In another fuel injection pump, known from German Offenlegungsschrift No. 19 19 707, the limited switching speed of magnetic valves is taken into consideration by accommodating two pumping systems in the distributor in this distributor-type pump. Each pumping system is supplied with fuel by way of a magnetic valve. In this manner, an increased pump rpm can be obtained. Furthermore, the cam drive of the pump pistons in this injection pump is designed such that the stroke speed of the pump piston during the suction stroke is much less than that during the supply stroke of the pump pistons. The magnetic valve of each pumping system of this radial-piston pump is also opened exclusively during the suction stroke of the pump pistons, and the opening duration of the magnetic valve determines the metered quantity. Here again, the rpm and the adjustment of injection time must be taken into consideration in controlling the magnetic valves. In designing this pump, the metering cycle of the magnetic valve begins with the suction stroke of the associated pump pistons. An adjustment of injection onset dictates a change in the onset of the suction stroke, so that this suction stroke onset must be provided precisely when calculating the opening time of the magnetic valve. Furthermore, dynamic conditions at the reversal point of the pump piston, that is, at the transition from the supply stroke to the suction stroke, are difficult to control.

OBJECT AND SUMMARY OF THE INVENTION

The fuel injection pump according to the invention has the advantage over the prior art that metering of the quantity of fuel to be injected can be controlled by electrical means and thus only one switching process, the opening or the closing of the fuel supply line by way of which the quantity of fuel to be metered reaches the work chamber of the fuel injection pump, is affected by the switching time, for instance of a magnetic valve. The other switching process is advantageously controlled mechanically and is executed sufficiently rapidly at every pump rpm. This is made possible in that the control times of the control edge on the one hand, which is guided in synchronism with pump rpm, and of the magnetic valve on the other overlap, and the fuel supply line is opened only at such a time as the control edge and the magnetic valve, which are located in series, have opened. Furthermore, the overlapping of the control times of the control edge in the magnetic valve also permit a relative shift in the opening point of the fuel supply line by means of the control edge with respect to the opening point of the fuel supply line of the magnetic valve, so that an adjustment of injection is possible without influencing the precision of control of the fuel quantity. The above provision makes it possible to control the injection pump sufficiently precisely even at high rpm.

By means of the characteristics disclosed, advantageous further embodiments of and improvements to the fuel injection pump disclosed can be attained.

The invention will be better understood and further objects and advantages thereof will become more apparent from the ensuing detailed description of one preferred embodiment taken in conjunction with the drawings.

DESCRIPTION OF THE PREFERRED EMBODIMENT

Figure 1:
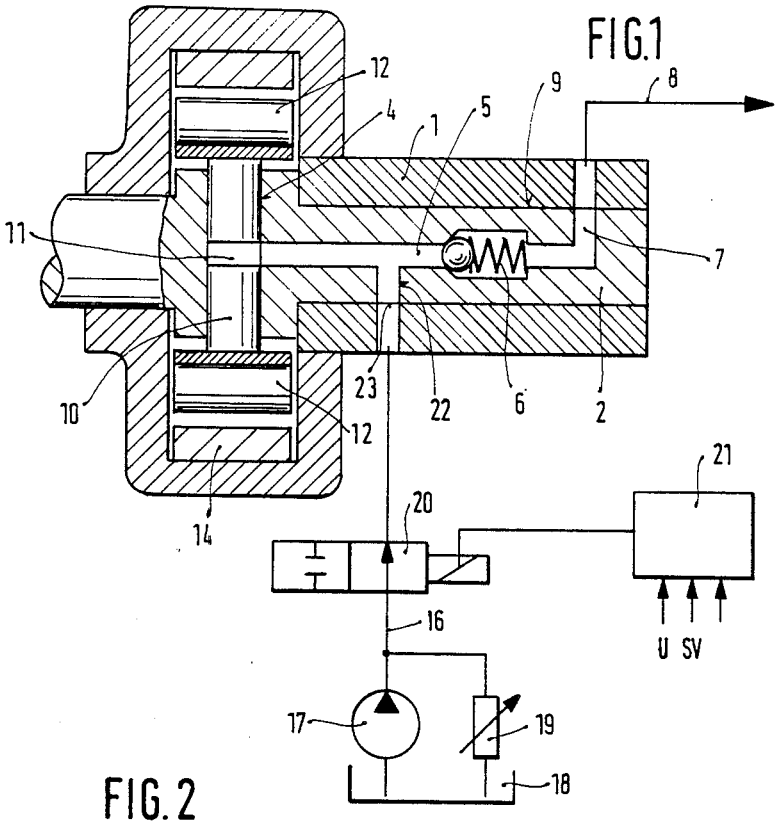
FIG. 1 shows the exemplary embodiment of the invention in its basic characteristics.

FIG. 1 of the drawings is a basic illustration of a known radial-piston pump, in which a rotating distributor 2 is supported in a pump housing 1 and is driven in synchronism with the rpm of the internal combustion engine. In a portion of the distributor 2 of enlarged diameter, a radial passageway bore 4 is provided. A supply conduit 5 leads away from this bore 4 in the axis of the distributor and contains a check valve 6. The end of the supply conduit 5 merges with a radially extending distributor bore 7. In the radial plane in which the distributor bore 7 is located, the pump housing 1 has injection lines 8, which, beginning at the cylinder bore 9 in which the distributor 2 is guided within the housing 1, lead to the individual injection locations of the engine. The injection lines are disposed on the circumference of the pump housing, distributed in accordance with the number of injection locations to be supplied and in the appropriate sequence therefor.

Two pump pistons 10 are disposed in the radial passageway bore 4, operating counter to one another and enclosing in the middle a pump work chamber 11 which communicates continuously with the supply conduit 5. The other side of the pump pistons is subjected to the action of rollers 12, which roll off on a cam ring 14 located in the radial plane. The pistons 10 are thus subject to centrifugal force, and during the rotary movement of the distributor are carried outward as long as the fuel charge in the pump work chamber 11 permits it. Accordingly, upon arrival of the rollers 12 on one cam of the cam ring, the pistons are moved then inward again. The pump pistons thereby execute the pump movement on the basis of which fuel is delivered through the supply conduit 5, by way of the check valve 6 and the distributor bore 7, into one of the injection lines 8.

The fuel charge of the pump work chamber is effected by way of the fuel supply line 16, which is connected to a supply pump 17. This pump aspirates fuel from a fuel supply container 18 and delivers it under pressure to the fuel supply line 16. The supply pressure is established with aid of a pressure control valve 19. A magnetic valve 20 is provided in the fuel supply lines and is controlled by a control device 21. The fuel supply line discharges radially into the cylinder 9 and at an appropriate rotary position of the distributor is made to communicate with the pump work chamber 11 by way of a radially extending supply bore 22. The supply bore 22 discharges into the supply conduit 5 between the pump work chamber 11 and the check valve 6. The outlet opening of the supply bore 22 into the cylinder 9 is embodied as a control edge 23.

Figure 2:
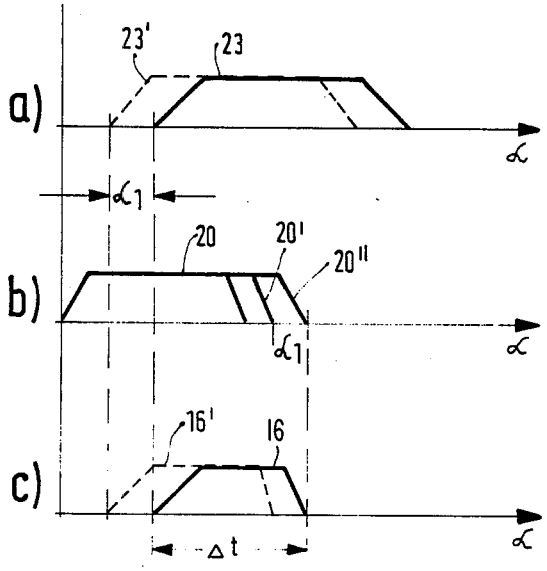
FIG. 2*a* is a diagram relating to the control times at which the fuel supply line is opened by the control edge, plotted over the rotary angle $\alpha$.
FIG. 2*b* shows the control times of the magnetic valve plotted over the rotary angle $\alpha$.
FIG. 2*c* shows the resultant opening time of the fuel supply line.

The mode of operation of the fuel injection pump described above will not be explained in terms of its supply with fuel, with the aid of the diagrams given in FIGS. 2*a* through 2*c*. In FIG. 2*a*, the curve 23 represents the opening time over the rotary angle, during which communication is established via the control edge 23 between the supply bore 22 and the fuel supply line. The curve 23′ shown in broken lines illustrates how curve 23 is shifted with respect to the rotary position or the rotary angle $\alpha$ when the cam ring 14 is rotated in order to adjust the injection time. Such apparatuses for injection timing adjustment are generally well known and will not be described in further detail but reference may be had to U.S. Pat. No. 4,037,574, wherein injection timing adjustment of a cam ring is disclosed.

FIG. 2*b* illustrates the opening time of the magnetic valve 20 with the aid of curve 20. While the opening time expressed by curve 23 in FIG. 2*a* is invariable in length, the opening time of the magnetic valve expressed by curve 20 can be made variable, this being shown by the various closing times expressed by curves 20′ and 20″. The two curves are associated with one another at an accurate rotary angle, and it can be seen that the magnetic valve is opened substantially earlier than is the supply bore 22 via the control edge 23.

FIG. 2*c* shows the remaining amount of opening time of the fuel supply line 16 corresponding to the overlapping of the opening times shown in FIGS. 2*a* and 2*b*. This opening time is now variable, depending on the closing time of the magnetic valve. If an adjustment in injection onset and thus a relative shift in curve 23 with respect to curve 23′ is effected by the rotary angle $\alpha_1$, then this shift must be compensated for by the closing time of the magnetic valve. The thus altered opening time of the fuel supply line 16′ is indicated in FIG. 2*c* by broken lines.

Figure 3:
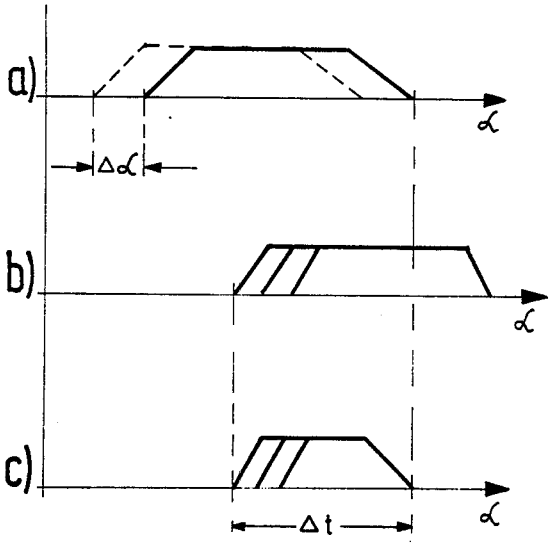
FIG. 3*a* shows the control times of the control edge for the case where the opening effected by the control edge is in advance of the opening effected by the magnetic valve.
FIG. 3*b* shows the associated control time.
FIG. 3*c* shows the resultant opening time of the fuel supply line in this case.

The sequence of FIGS. 3*a*-3*c* illustrates a form of embodiment which is equally possible, and in which the fuel supply line or the supply bore 22 is opened earlier than the magnetic valve. In principle, the same effects as described above are brought about.

The magnetic valve is controlled in a conventional manner by the control device 21 in accordance with the quantity of fuel to be measured, which is substantially a product of load and other engine parameters. Corrections are required in accordance with the injection adjustment. The control unit furthermore receives signals for the rpm or for the position of some reference point, indentifying a specific rotary angle position of the distributor 2.

Figure 4:
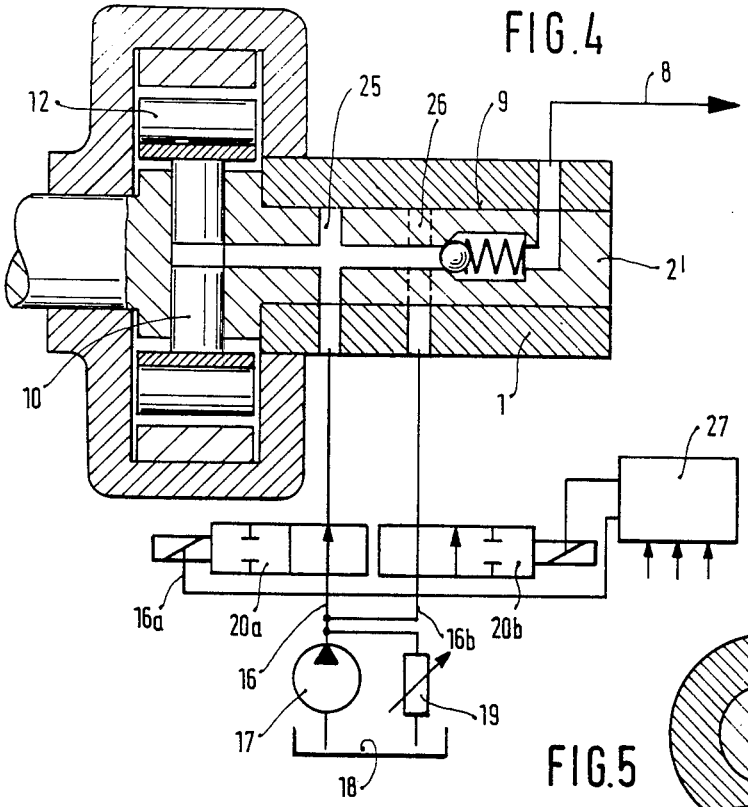
FIG. 4 illustrates the use of two magnetic valves, each in a discharge point of the fuel supply line, offset by 90° into the pump housing.
Figure 5:
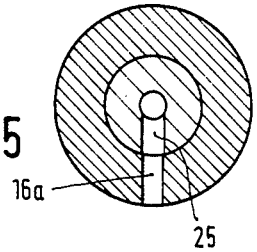
FIG. 5 is a first section taken through the fuel injection pump shown in FIG. 4, in the plane of the first fuel supply line discharge point into the pump body.
Figure 6:
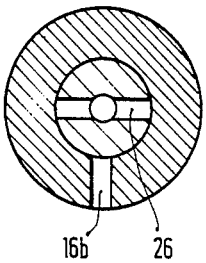
FIG. 6 is a second section taken through the fuel injection pump shown in FIG. 4, in the plane of the second discharge point of the second fuel supply line into the pump body.

In FIG. 4, instead of a supply bore 22, two supply bores 25 and 26, located in parallel radial planes, are provided in the distributor 2′. The fuel supply line 16 is furthermore subdivided into a partial line 16*b*, which discharge into the cylinder bore 9 of the pump housing 1 in the radial plane defined by the supply bores 25 and 26. Each of the partial lines 16 and 16*b* has an associated magnetic valve 20*a* and 20*b*, which are triggered in alternation by the control unit 27. As shown control line 16*a* controls the magnetic valve 20*a*. Both supply bores 25 and 26 discharge into the supply conduit 5, as in the case of the injection pump of FIG. 1, but in this case are displaced relative to one another by 90°. FIGS. 5 and 6 each show a section in the radial plane defined by the supply bores 25 and 26 through the fuel injection pump in the illustrated position.

This embodiment makes it possible to bring about a higher number of injections per revolution of the distributor. It is thereby assured that the magnetic valves can be opened sufficiently soon before the opening of the supply bores 25 and 26 or, in the opposite case, sufficiently long after the closing of the supply bores 25 or 26, so as to enable long injection adjustment times. With only two discharge points of the fuel supply line into the cylinder bore 9, four injection cycles per revolution of the distributor can be executed in this manner.

The substantial advantage of the described method of fuel metering is that the influence on the fuel metering quantity exerted by the finite switching times of the magnetic valve, which in terms of amount are equal but with increasing rpm would cause a proportionately increasing amount of error, is reduced. The error in switching time now becomes part of the metering product only with one edge of the switching of the magnetic valve. Valves which switch as rapidly as possible are used, being electrically controllable; they may be embodied as magnetic valves, for instance. Naturally, other valves are also possible, by means of which a closing or opening of the supply line is effected in response to an electrical signal (for example piezo valves).

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump having a pump work chamber enclosed by a pair of pump pistons in a cylinder, the chamber being connectable via at least one fuel supply conduit with a plurality of fuel injection locations in a rotating distributor and further connectable during a suction stroke with a fuel supply line via a plurality of fuel supply bores displaced realtive to each other in said rotating distributor, said plurality of bores being controlled by a control edge guided in synchronism with the rpm of said fuel injection pump, said fuel supply line having a supply source and a pressure regulator, each of said fuel supply bores having a fuel supply line controlled in alternation by an electrically controlled valve to meter fuel via said fuel supply bores, a control device which controls each electrically controllable valve whereby a limitation of the duration of the open communication between said pump work chamber and each fuel supply line can be created on the one hand by means of a switching process of each electrically controllable valve and on the other hand by means of one of the control processes of each control edge, and further wherein the opening times of each electrically controllable valve is variable by means of said control device for controlling said fuel injection quantity and the opening periods of each electrically controllable valve and of the opening of each fuel supply line controlled by each control edge arranged to overlap one another.

2. A fuel injection pump having a pump work chamber enclosed by a pair of pump pistons in a cylinder, the chamber being connectable via at least one fuel supply conduit with a plurality of fuel injecton locations in a rotating distributor and further connectable during a suction stroke with a fuel supply line via a plurality of fuel supply bores displaced relative to each other in said rotating distributor, said plurality of bores being controlled by a control edge guided in synchronism with the rpm of said fuel injection pump, said fuel supply line having a supply source and a pressure regulator, which establishes the pressure of said fuel supply source at a constant level, each of said fuel supply bores having a fuel supply line controlled in alternation by an electrically controlled valve to meter fuel via said fuel supply bores, a control device which controls each electrically controllable valve whereby a limitation of the duration of the open communication between said pump work chamber and each fuel supply line can be created on the one hand by means of a switching process of each electrically controllable valve and on the other hand by means of one of the control processes of each control edge, and further wherein the opening times of each electrically controllable valve is variable by means of said control device for controlling said fuel injection quantity and the opening periods of each electrically controllable valve and of the opening of each fuel supply line controlled by each control edge arranged to overlap one another.

* * * * *